US005586423A

United States Patent [19]

Mullen

[11] Patent Number: 5,586,423

[45] Date of Patent: Dec. 24, 1996

[54] BUILDING HANDRAIL BRACKET

[76] Inventor: George P. Mullen, 2956 Rogue River Hwy., Grants Pass, Oreg. 97527

[21] Appl. No.: 510,163

[22] Filed: Aug. 2, 1995

[51] Int. Cl.[6] ..... E04H 12/10

[52] U.S. Cl. ..... 52/653.2; 52/DIG. 12; 52/704; 256/DIG. 6; 256/65; 182/45

[58] Field of Search ..... 52/DIG. 12, 27, 52/745.21, 298, 698, 704, 705, 706, 707, 653.2; 256/DIG. 6, 65; 182/45, 113

[56] References Cited

U.S. PATENT DOCUMENTS

| | | | |
|---|---|---|---|
| 977,709 | 12/1910 | Craig . | |
| 3,406,946 | 10/1968 | Saultz . | |
| 3,632,089 | 1/1972 | Smith . | |
| 4,084,362 | 4/1978 | Piazza | 52/705 X |
| 4,236,698 | 12/1980 | Compte | 182/113 X |
| 4,309,135 | 1/1982 | Gutshall | 411/17 |
| 4,462,573 | 7/1984 | Melfi et al. . | |
| 4,650,134 | 3/1987 | Shepherd | 256/65 X |
| 5,182,889 | 2/1993 | Johnson | 182/113 X |
| 5,263,550 | 11/1993 | Jines et al. | 182/113 |
| 5,314,167 | 5/1994 | Holloman . | |

*Primary Examiner*—Carl D. Friedman
*Assistant Examiner*—Timothy B. Kang
*Attorney, Agent, or Firm*—Jacobson, Price, Holman & Stern, PLLC

[57] ABSTRACT

An L-shaped bracket including a tubular lower horizontal leg and a tubular upstanding leg with an inner corner gusset structure secured between the horizontal and upstanding legs. The upstanding leg includes structure for releasably rigidly securing the lower end of an upright railing post therefrom and the tubular horizontal leg receives a threaded shank-type fastener therethrough for threaded engagement in a building structure anchored outwardly opening threaded socket member against which the end of the tubular horizontal leg remote from the upstanding leg is tightly endwise abutted.

6 Claims, 2 Drawing Sheets

BUILDING HANDRAIL BRACKET

BACKGROUND OF THE INVENTION

1. Field of the Invention

This invention relates to an L-shaped bracket including a tubular lower horizontal leg and a tubular upstanding leg, inner corner gusset structure being secured between the horizontal and upstanding legs. The upstanding leg includes structure for releasably rigidly securing the lower end of an upright railing standard therefrom and the tubular horizontal leg may receive a threaded shank-type fastener therethrough engageable in a threaded socket defined by an anchor member fixedly anchored in a concrete or masonry wall, fixedly anchored in the outer edge of a concrete floor slab or fixedly anchored to a girder or the like of a building being constructed.

2. Description of Related Art

Various different forms of temporary railing support structures are disclosed in U.S. Pat. Nos. 3,406,946, 3,632,089, 5,182,889 and 5,314,167. In addition, U.S. Pat. Nos. 977, 709, 4,309,135 and 4,462,573 disclose structures including minor individual features of the instant invention.

However, these prior patents do not disclose the concept of the instant invention wherein an L-shaped mounting bracket is provided including interconnected tubular horizontal and upstanding legs with the upstanding leg being adapted to be telescopically engaged with a safety rail post or standard and the horizontal leg being adapted to have a coil bolt passed therethrough for threaded connection with a coil anchor securely anchored relative to an associated building structure.

SUMMARY OF THE INVENTION

Safety requirements of various types are enforced throughout this country for the protection of workmen constructing a building. One of these safety requirements is that safety railings be present at each open floor of a building being constructed and about the top thereof to greatly lessen the possibility of a workman falling out of the periphery of a building.

Present safety rules require that a 42 inch railing be erected at each floor opening and that the railing, at each upright post (with adjacent posts spaced not more than 8 feet apart) resist a 200 pound lateral outward force.

It is presently customary for the lower end of such a safety railing post to be nailed against the outer surface of a building wall or the outer surface of a building floor slab. While this nailing process, in most cases, will provide a railing post which will initially resist a 200 pound lateral outward thrust, in some instances, where the lower end of such a railing upright is nailed to the outer edge of a floor slab which may be only 10 or 12 inches in thickness, the initial anchoring of a railing post in this manner is not always sufficient to meet the 200 pound lateral force requirement at the upper end thereof. Of course, it is indeed a rarity that each and every railing upright secured in this manner is tested. Further, once a railing upright has been nailed in position in this manner and has endured several or more minor lateral thrusts, the nails securing that railing upright in position may be loosened to the extent that the 200 pound lateral thrust test cannot be passed.

This of course results in a potentially dangerous situation for building construction workmen.

It is therefore the main object of this invention to provide a building handrail upright mounting bracket which may be utilized in the construction of substantially all masonry, concrete and steel buildings for erecting safety handrailing which far exceeds current safety regulations.

It is proposed that the mounting bracket of the instant invention be utilized in conjunction with commercially available hand rail posts and independent testing of such handrail posts anchored to a building through the use of the mounting bracket of the instant invention has proven to result in an extremely strong mounting of a handrail post capable of withstanding 630 pounds of lateral outward force, at which point the hand rail posts bent while the mounting bracket of the instant invention remained securely anchored to the associated building.

A further object of this invention is to provide a safety handrail post mounting bracket which may be utilized in the construction of concrete, masonry and steel frame buildings.

Another object of this invention is to provide a handrail post mounting bracket in accordance with the preceding objects and which may be readily constructed at a low cost.

Another very important object of this invention is to provide a handrail post mounting bracket specifically designed to be used in conjunction with a coil insert presently commonly in use for other purposes.

A final object of this invention to be specifically enumerated herein is to provide a safety handrail post mounting bracket in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
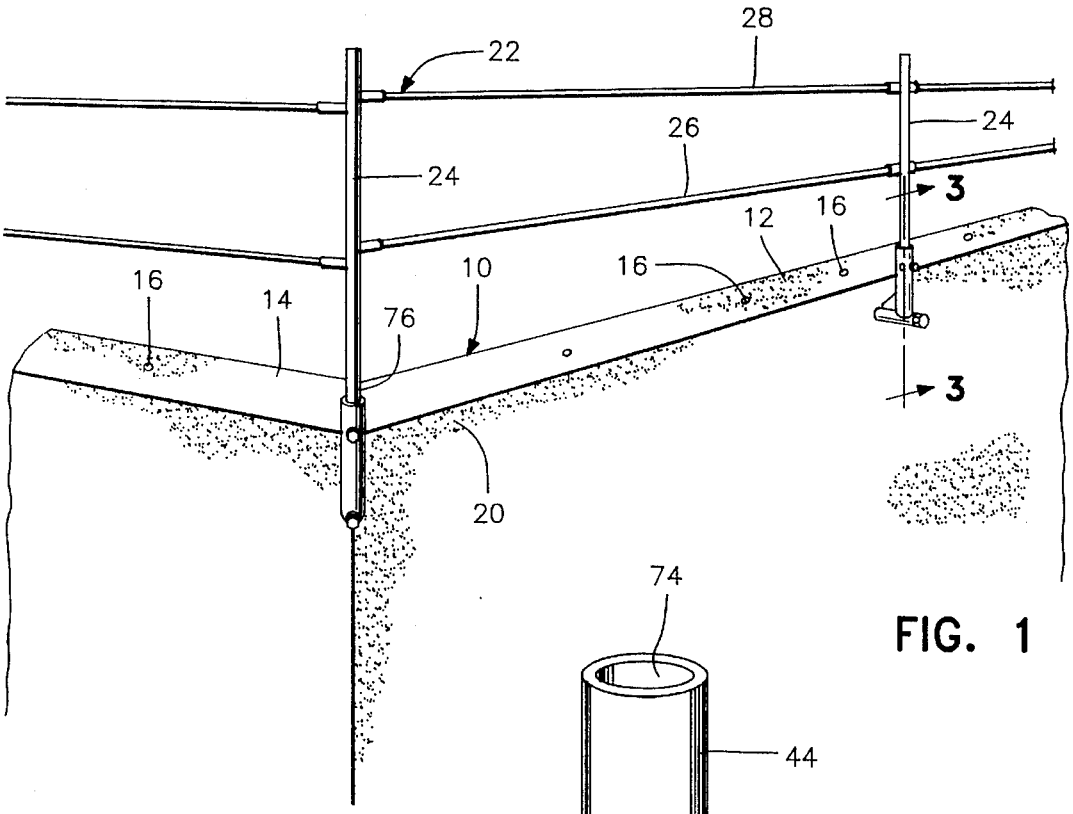
FIG. 1 is a fragmentary perspective view of one corner portion of a poured concrete building wall construction including vertical reinforcing bars extending therethrough and with a safety handrail extending about the upper periphery of the building walls and mounted from the latter utilizing the mounting bracket of the instant invention.
Figure 4:
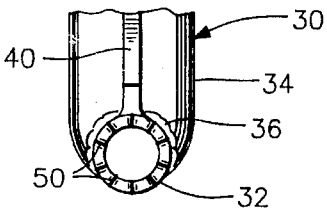
FIG. 4 is a fragmentary end elevational view of the lower portion of the mounting bracket as seen from the toothed end of the tubular horizontal leg thereof.

Referring now more specifically to the drawings the numeral 10 generally designates a building corner portion defined by two relatively angulated and intersecting poured concrete walls 12 and 14 each having vertical reinforcing rods 16 therein. The walls 12 and 14 are monolithic in construction, although they could be separately formed and joined together in any convenient manner. In addition, each wall 12 and 14 could incorporate a plurality of separately formed wall sections joined together in any convenient manner. In the latter instance, such wall sections may be poured while in horizontal forms and raised to upright positions in order to form the corresponding wall.

Also, the corner portion 10 could comprise a masonry structure constructed of concrete blocks or the like, or the corner portions 10 could be representative of a steel skeletal framework.

In any event, the corner portion 10 includes an upper margin 20 along which a safety railing 22 must be erected. Present regulations require that the uprights 24 of the railing 22 must withstand a 200 pound lateral outward thrust and the uprights 24 are horizontally spaced no more than 8 feet apart and support lower and upper rails 26 and 28 extending therebetween at 24 inch and 42 inch heights, respectively, above the upper margin 20. However, if the upper margin 20 comprises a parapet projecting above the roof (not shown) of the associated building, only the rails 28 at 42 inch height above the upper margin are required.

As hereinbefore set forth, the uprights 24, in the past, usually comprise 2 inch by 4 inch lumber sections of perhaps 54 inches in height having their lower ends nailed to the walls 12 and 14. While in most instances such uprights or posts will resist an initial 200 pound lateral outward thrust, in many instances such uprights will be jarred numerous times after they are erected and before they are taken down with the result that such nailing may become loosened to the extent that the uprights will no longer resist a 200 pound lateral outward thrust.

In order to provide an extremely more rigid and dependable anchor for the lower ends of uprights such as the tubular uprights 24, a handrail building bracket referred to in general by the reference numeral 30 and comprising the instant invention is provided. The tubular uprights 24 may comprise "SAFEWAY" hand rail or upright scaffold posts. The bracket 30 is L-shaped in form including a short lower horizontal tubular member or pipe 32 and a longer upright tubular member or pipe 34. The lower pipe 32 is constructed of a strong durable metal and is generally ¾ inches in diameter and a little less than 4½ inches in length. The upright pipe 34, on the other hand, is generally 1½ inches in diameter and approximately 8¾ inches in length, the lower end thereof being notched and inwardly tapered for securement, by welding as at 36, to the outer end 38 of the lower pipe 32.

A plate-like gusset 40 is secured between the inner end 42 of the lower pipe 32 and the corresponding side of the lower end of the upright pipe 34 and the upper end portion 44 of the upright pipe 34 is provided with pairs of diametrically opposite radial bores 46 and 48 therethrough for purpose to be here in more fully set forth.

The end face of the inner end portion 42 of the lower pipe 32 is provided with circumferentially spaced endwise outwardly facing teeth 50 and a BURKE ND-321 coil rod 52, commonly known as a coil bolt, is slidingly received through the lower pipe 32 and includes a hexagonal head 54 on its outer end.

Figure 2:
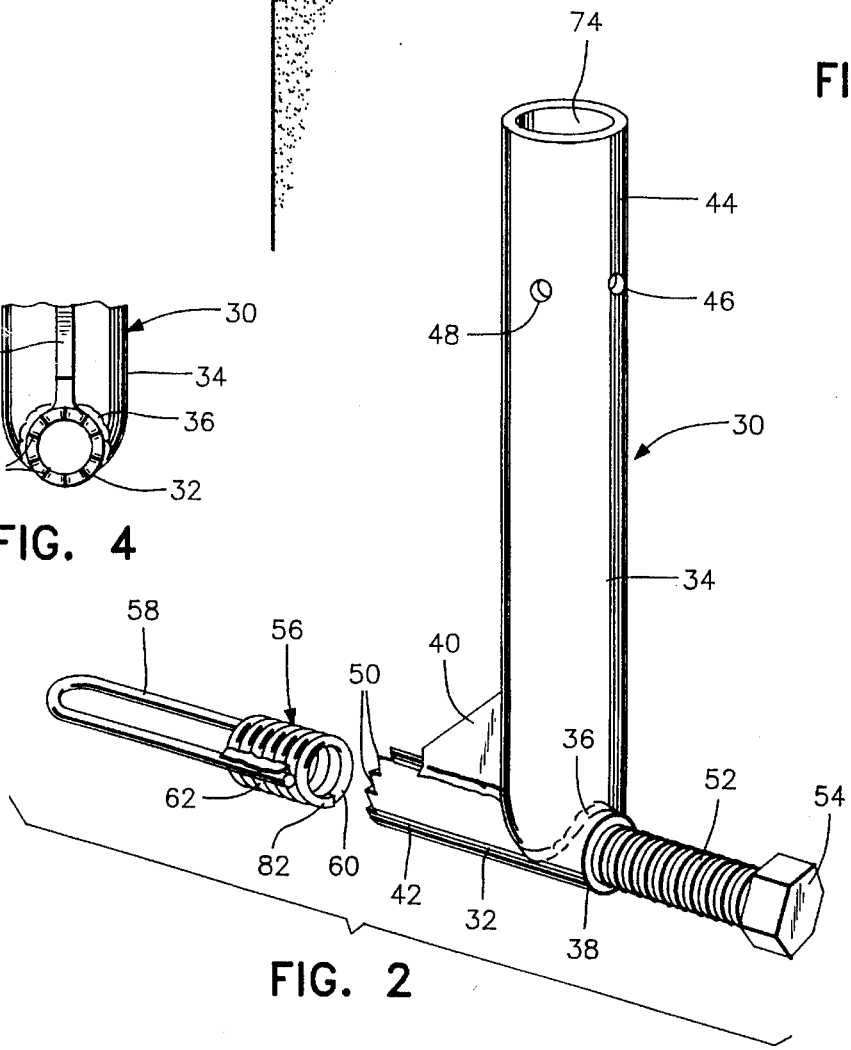
FIG. 2 is an enlarged perspective view of a first form of mounting bracket constructed in accordance with the present invention and illustrated in operative association with a coil insert and a coil fastener.
Figure 3:
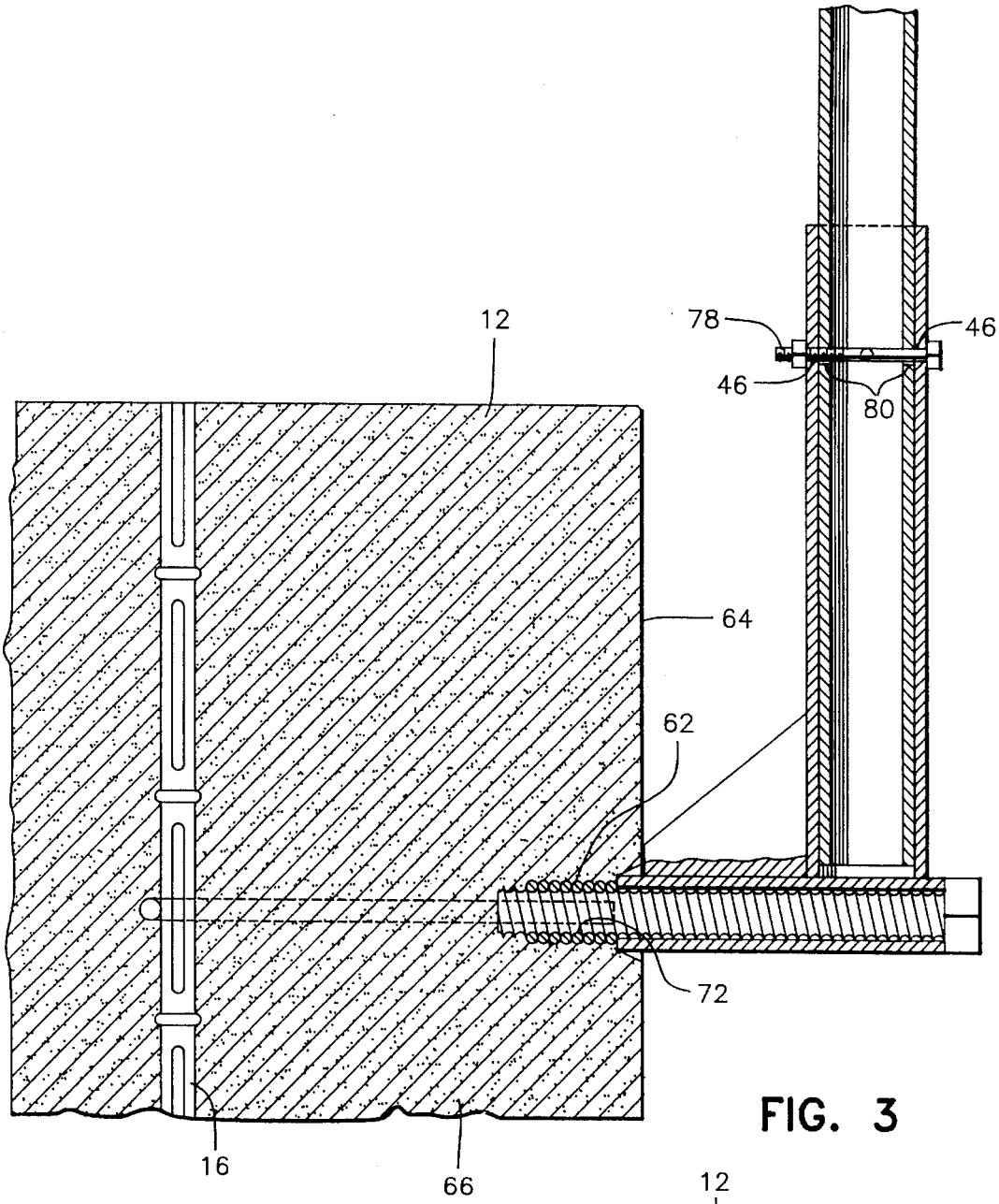
FIG. 3 is an enlarged fragmentary vertical sectional view taken substantially upon the plane indicated by the section line 3—3 of FIG. 1.

With attention now more specifically to FIGS. 2 and 3 of the drawings, it may be seen that a BURKE #EW-106 ¾ inch by 6 inch coil insert referred to in general by the reference numeral 56 and commonly known as a steel coil anchor is embedded within the wall 12 with one of the vertical reinforcing rods 16 extending downwardly through the U-shaped bail portion 58 of the coil insert 56. The end face 60 of the coil body 62 of the insert 56 is recessed slightly inward of the outer surface 64 of the wall 12.

When the wall 12 is formed, the cementious material 66 thereof is poured around the reinforcing bar 16 and the coil insert 56 with a threaded plastic plug 68 threaded into the coil body 62 and the head 70 of the plug 68 flush with the outer surface 64. In this manner, the fluent cementious material of which the wall 12 is constructed is prevented from blocking the end face 60 of the coil body 62 or entering the coil body 62. Of course, once the wall 12 has been formed, the plug 68 is removed in order to expose the threaded socket 72 defined by the coil body 62.

When it is desired to anchor the bracket 30 to the wall 12 after the plug 68 has been removed, the inner end 42 of the lower pipe 32 is aligned with the coil body 62 and the coil rod 52 is displaced inwardly through the lower pipe 32 and threaded into the coil body 62 until the teeth 50 bite into the end face 60 and the head 54 tightly clamps the lower pipe 32 between the head 54 and the end face 60.

At this point, an upwardly opening socket 74 is defined and is rigidly supported in position spaced slightly outward of the outer surface 64 of the wall 12 and projecting slightly above the upper margin 20 thereof. At this point, the lower end portion 76 of a selected upright or post 24 may be snugly downwardly telescoped into the socket 74 and secured therein through the utilization of a removable diametric bolt 78 secure through one pair of the bores 46 and 48 and the corresponding diametrically opposite bores 80 formed in the upright 24.

By utilizing the bracket 30 in this manner to support the upright 24, it has been found that the upright or post 24 comprising a SAFEWAY post, will withstand a 630 pound lateral outward thrust, at which point the upright 24 bends immediately above the upright pipe 34 without the bracket 30 incurring any damage.

Figure 5:
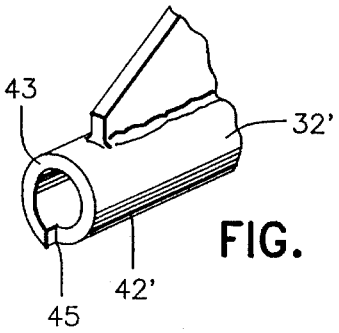
FIG. 5 is a fragmentary perspective view of a modified form of mounting bracket illustrating a notched convolute surface for precise mating with the outer end of the associated coil insert.
Figure 6:
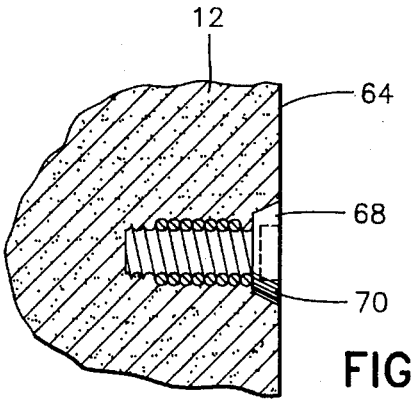
FIG. 6 is a fragmentary vertical sectional view similar to FIG. 3, but with the handrail post mounting bracket removed and the coil insert having a protective plug removably threaded therein.

It will be noted that the teeth 50 engage, for the most part, only the outer end 82 of the coil body 62. However, FIG. 5 of the drawings illustrates a modified form of lower pipe 32' whose inner end 42' is convolute as at 43 and stepped as at 45 to mate perfectly with the stepped convolute end face 60. Thus, when the lower pipe 32' is utilized, substantially full contact engagement between the inner end 42' of the lower pipe 32' and the end face 60 of the coil body 62 is achieved. Of course, the full surface engagement of the end face 43 with the end face 60 and the tooth engagement of the inner end 42 with the end face 60 insures that the upright pipes 34 will be maintained upright when the coil rod 52 has been fully tightened.

If the bracket is to be used on a steel frame building being constructed, the insert 56 is modified to include a mounting flange (not shown) in lieu of the bail portion 58 thereof and such mounting flange is welded to the building frame work.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a building construction including a threaded socket member opening horizontally outwardly therefrom, an L-shaped bracket incorporating (1) a tubular lower horizontal leg defining first and second end portions and a longitudinal passage extending therethrough opening outwardly through said end portions and (2) an upstanding leg rigidly supported from and projecting upwardly from said second end portion, said upstanding leg defining a support structure operative to releasably support the lower end of an upstanding railing post therefrom in predetermined height adjusted position relative to said bracket, and threaded fastener structure extending through said passage and removably threaded into said threaded socket member, said second end portion including an end face opposing and tightly seated against said socket member, said socket member being fixedly anchored in said building construction independent of said threaded fastener.

2. The combination of claim 1 wherein said end face includes circumferentially spaced, endwise outwardly facing teeth disposed in tooth engagement with said socket member.

3. The combination of claim 1 wherein said end face is stepped, convolute in contour and said socket member comprises a coil insert including a stepped, convolute outer end against which said end face is seated in mated fashion.

4. The combination of claim 1 including a plate-like gusset extending and secured between said horizontal and upstanding legs at the inside corner of said L-shaped bracket.

5. In combination with a building construction including a threaded socket member opening horizontally outwardly therefrom, an L-shaped bracket incorporating (1) a tubular lower horizontal leg defining first and second end portions and a longitudinal passage extending therethrough opening outwardly through said end portions and (2) an upstanding leg rigidly supported from and projecting upwardly from said second end portion, said upstanding leg defining a support structure operative to releasably support the lower end of an upstanding railing post therefrom in predetermined height adjusted position relative to said bracket, and threaded fastener structure extending through said passage and removably threaded into said threaded socket member, said second end portion including an end face opposing and tightly seated against said socket member, said end face including circumferentially spaced endwise outwardly facing teeth.

6. In combination with a building construction including a threaded socket member opening horizontally outwardly therefrom, an L-shaped bracket incorporating (1) a tubular lower horizontal leg defining first and second end portions and a longitudinal passage extending therethrough opening outwardly through said end portions and (2) an upstanding leg rigidly supported from and projecting upwardly from said second end portion, said upstanding leg defining a support structure operative to releasably support the lower end of an upstanding railing post therefrom in predetermined height adjusted position relative to said bracket, and threaded fastener structure extending through said passage and removably threaded into said threaded socket member, said second end portion including an end face opposing and tightly seated against said socket member, said end face being stepped convolute in contour and said socket member comprising a coil insert including a stepped convolute outer end against which said end face is seated in mated fashion.

* * * * *